US008396703B2

(12) United States Patent
Aoyagi

(10) Patent No.: US 8,396,703 B2
(45) Date of Patent: Mar. 12, 2013

(54) VOICE BAND EXPANDER AND EXPANSION METHOD, AND VOICE COMMUNICATION APPARATUS

(75) Inventor: Hiromi Aoyagi, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 441 days.

(21) Appl. No.: 12/379,972

(22) Filed: Mar. 5, 2009

(65) Prior Publication Data

US 2009/0240489 A1 Sep. 24, 2009

(30) Foreign Application Priority Data

Mar. 19, 2008 (JP) ..... 2008-071466

(51) Int. Cl.
*G10L 19/14* (2006.01)

(52) U.S. Cl. ..... 704/205; 704/207; 704/209; 704/219

(58) Field of Classification Search ..... 704/219, 704/265, 220, 207, 209, 200, 205, 206
See application file for complete search history.

(56) References Cited

U.S. PATENT DOCUMENTS 6,691,092 B1 * 2/2004 Udaya Bhaskar et al. .... 704/265
7,283,955 B2 * 10/2007 Liljeryd et al. ..... 704/219
7,353,168 B2 * 4/2008 Thyssen et al. ..... 704/220
2002/0016698 A1 2/2002 Tokuda

FOREIGN PATENT DOCUMENTS

JP 2002-082685 3/2002
WO WO-98/57436 A 12/1998

OTHER PUBLICATIONS

Yasukawa, H., "A simple method of broad band speech recovery from narrow band speech for quality enhancement", 1996 IEEE Digital Signal Processing Workshop Proceedings, Sep. 1-4, 1996, Loen, Norway, pp. 173-175.

* cited by examiner

*Primary Examiner* — Huyen X. Vo
(74) *Attorney, Agent, or Firm* — Rabin & Berdo, P.C.

(57) ABSTRACT

A band-limited voice signal is processed to reduce its spectral envelope or harmonic structure, or both. The resulting reduced signal is moved into a frequency band above the upper limit frequency of the band-limited voice signal, and then combined with the band-limited voice signal to form a band expanded signal with improved quality and comprehensibility, free of unnatural high-frequency resonances and unnaturally strong high-frequency harmonics.

15 Claims, 3 Drawing Sheets

VOICE BAND EXPANDER AND EXPANSION METHOD, AND VOICE COMMUNICATION APPARATUS

BACKGROUND OF THE INVENTION

1. Field of the Invention

The present invention relates to a voice band expander and expansion method and a voice communication apparatus that enhance a band-limited voice signal by adding high frequency components not present in the band-limited voice signal.

2. Description of the Related Art

Telephone transmission has traditionally been limited to the frequency band from 300 Hz to 3,400 Hz. Although this limited frequency band permits intelligible voice communication, the quality of the reproduced voice signal is unsatisfactory, and sometimes the voice signal is not reproduced clearly enough to be easily comprehended.

Various attempts have been made to solve this problem by band expansion, that is, by adding frequencies above 3,400 Hz or below 300 Hz to the reproduced signal. In Japanese Patent Application Publication No. 2002-82685, for example, Tokuda describes a band expansion method in which a band-limited voice signal is folded over to generate high frequency components that are added to the band-limited voice signal as shown in FIGS. 1A and 1B. In these drawings Fs represents the sampling frequency of the telephone equipment. Fs/2 is the upper limit of the band-limited signal and the center of symmetry of the foldover process.

There are, however, two problems with this foldover method.

One problem is related to the resonant frequency components of a voice signal referred to as formants. In general, formants produce a spectral envelope with pronounced peaks and troughs, as exemplified by the dotted line in FIG. 1A. If this spectral shape is directly folded over into the higher frequency band above the limited voice band), it produces peaks that were not present in the high-frequency spectrum of the original voice signal, resulting in a reproduced voice signal distorted by extraneous resonances.

The other is a problem of harmonic frequency structure. The harmonic frequency structure of a voice signal, indicated schematically by the solid lines in FIG. 1A, reflects the pitch of the speaker's voice. This harmonic structure is also present in the high frequencies excluded from the limited voice band, but at a lower intensity. The harmonic structure of the foldover components generated in the higher frequency band by the technique disclosed by Tokuda has too high an intensity: the higher harmonics fail to decay properly, resulting in an unnaturally shrill reproduced voice signal.

An alternative to the foldover method is frequency shifting, in which the band-limited frequency spectrum is shifted or copied directly into the higher frequency band above the limit frequency, but this method fails to solve the above two voice quality problems.

The invention also provides a voice band expander using the invented method, and a communication apparatus using the voice band expander.

SUMMARY OF THE INVENTION

An object of the present invention is to expand the frequency band of a band-limited voice signal in a way that produces a natural sounding voice signal with improved quality and comprehensibility.

The invention provides a method that starts by generating, from the band-limited voice signal, a reduced signal with a reduced frequency spectrum in which the spectral envelope or harmonic structure, or both, of the band-limited voice signal voice signal is/are reduced. A band expanding signal having a frequency spectrum located above the upper limit of the limited band of the voice signal is then generated from the reduced signal. The band-limited voice signal and the band expanding signal are combined to form a band expanded signal.

The spectral envelope of the band-limited voice signal may be reduced by suppressing formants. This can be done by carrying out a linear predictive coding analysis of the input voice signal and using the resulting coefficients.

The harmonic structure of the band-limited voice signal may be reduced by determining the pitch and pitch intensity of the band-limited voice signal filtering the signal so as to attenuate the fundamental frequency and its harmonics.

The reduced signal can then be shifted, folded over, or otherwise moved into the frequency band above the upper limit of the limited band without introducing unnatural resonances or unnaturally strong high-frequency components.

DETAILED DESCRIPTION OF THE INVENTION

Figure 1A:
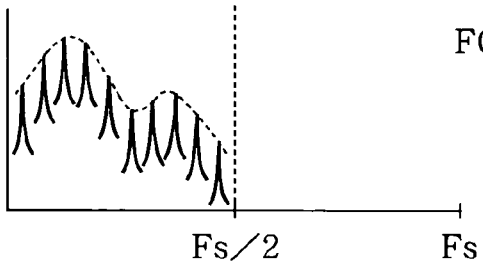
FIGS. 1A and 1B are graphs illustrating the conventional foldover method of voice band expansion.
Figure 1B:
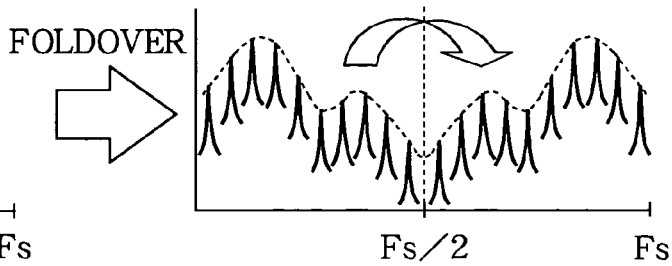

An embodiment of the invention will now be described with reference to the attached drawings, in which like elements are indicated by like reference characters.

Figure 2:
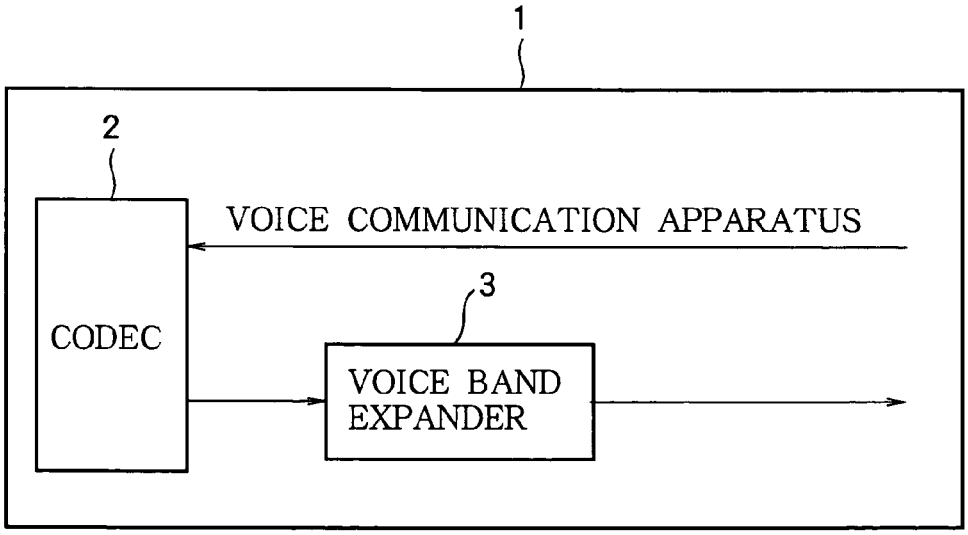
FIG. 2 is a block diagram showing the general structure of a voice communication apparatus embodying the invention.

Referring to FIG. 2, the voice communication apparatus 1 in the embodiment is, for example, an Internet protocol (IP) telephone apparatus (either a hardware apparatus or a so-called softphone) including a codec 2 for compressive coding of a voice signal to be transmitted and decoding of a received coded voice signal. A decoded voice signal output from the codec 2 is supplied to a voice band expander 3, in which the limited band of the decoded voice signal is expanded on the high frequency side. When a softphone is used as the voice communication apparatus 1, the codec 2 and the voice band expander 3 are implemented by a central processing unit (CPU) and software (e.g., a codec program and a voice signal expansion program) executed by the CPU.

Figure 3:
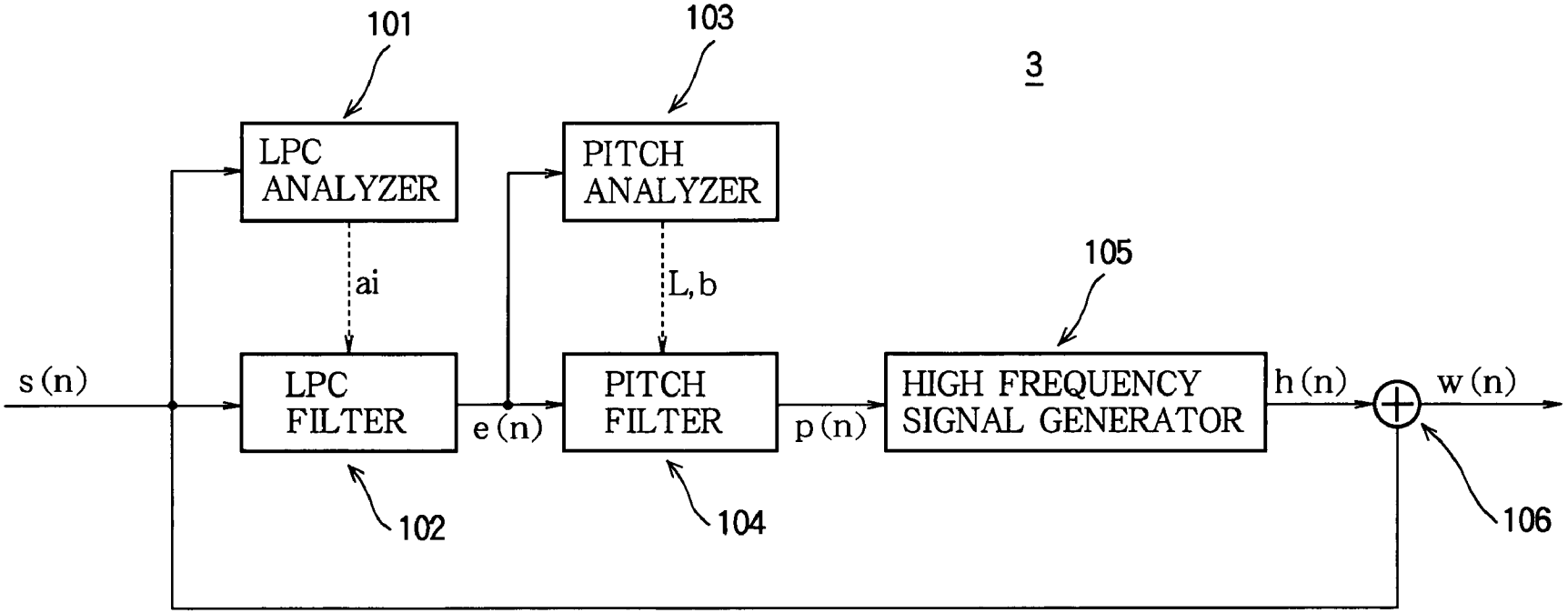
FIG. 3 is a block diagram illustrating the internal structure of the voice band expander in FIG. 2.

FIG. 3 illustrates the internal structure of the voice band expander 3 in this embodiment. If the voice band expander 3 is implemented by a CPU and a voice signal expansion program executed by the CPU, FIG. 3 represents functional units in the voice signal expansion program.

The voice band expander 3 includes a linear predictive coding (LPC) analyzer 101, an LPC filter 102, a pitch analyzer 103, a pitch filter 104, a high frequency signal generator 105, and an adder 106.

The LPC analyzer 101 receives a (digital) voice signal s(n) organized into intervals referred to as frames, each frame having a length of, for example, ten milliseconds (10 ms). The frames may be non-overlapping or partially overlapping, e.g., half-overlapping. In this embodiment, the voice signal s(n)

input to the LPC analyzer 101 has an artificially limited bandwidth. The LPC analyzer 101 analyzes the input voice signal s(n) to obtain LPC coefficients $a_i$ (where i is an index integer representing order in the LPC analysis) for the LPC filter 102.

The LPC filter 102 uses the LPC coefficients $a_i$ to reduce or suppress the formant structure of the voice signal s(n), and thereby generates a first reduced signal e(n). The first reduced signal e(n), may be obtained by multiplying the voice signal s(n) by the transfer function $H_{LPC}(z)$ expressed by Eq. (1) below, in which z is a complex variable. The summation in Eq. (1) is on orders from one to the greatest order (i=1, 2, . . . ). The symbol α denotes a parameter greater than zero and equal to or less than unity, defining an amount of suppression or attenuation (0<α≦1). The parameter α may be externally set by the user: for example, α may be varied by a potentiometer control operated by the user. The multiplication operation is performed in the z-transform domain, i.e., the complex frequency domain.

$$H_{LPC}(z) = 1 - \sum_i \alpha^i \cdot a_i \cdot z^{-i} \quad \text{Eq. (1)}$$

The pitch analyzer 103 calculates a pitch period L and pitch intensity b from the first reduced signal e(n) and outputs the results to the pitch filter 104. The pitch period L indicates the pitch of the speaker's voice, and the pitch intensity indicates the loudness of the voice. These values may be calculated by the autocorrelation method or other known methods. The signal used in the calculation may be the input voice signal s(n) instead of the first reduced signal e(n).

The pitch filter 104 generates a second reduced signal p(n) by decimating or reducing the pitch harmonic structure of the first reduced signal e(n), based on the received pitch period L and pitch intensity b. To obtain the second reduced signal p(n), the pitch filter 104 applies the transfer function $H_P(z)$ expressed by Eq. (2) to the first reduced signal e(n). In Eq. (2), β is a parameter greater than zero and equal to or less than unity, defining an amount of reduction or attenuation (0<β≦1). The parameter β may also be externally set by the user (for example, by operating by another potentiometer control).

$$H_P(z) = 1 - \beta \cdot b \cdot z^{-L} \quad \text{Eq. (2)}$$

From the second reduced signal p(n), the high frequency signal generator 105 generates an expanding signal h(n) having a frequency spectrum higher than the upper limit frequency of the limited band of the input signal s(n). The expanding signal h(n) is output to the adder 106. The frequency spectrum of the expanding signal h(n) may be obtained by a known method such as the frequency shift method or the foldover method described by Tokuda.

The adder 106 adds the input voice signal s(n) and the expanding signal h(n) together, thereby generating a band expanded signal w(n).

FIGS. 4A to 4D show frequency spectra of the signals s(n), p(n), h(n), and w(n).

As described above, the LPC analyzer 101, the LPC filter 102, and the adder 106 receive a voice signal s(n) with a predetermined frame length of, for example 10 ms. The input voice signal s(n) has an artificially limited bandwidth with an upper limit frequency designated Fs/2 in FIG. 4A, which schematically represents the frequency spectrum of one exemplary frame of the input voice signal s(n).

Figure 4A:
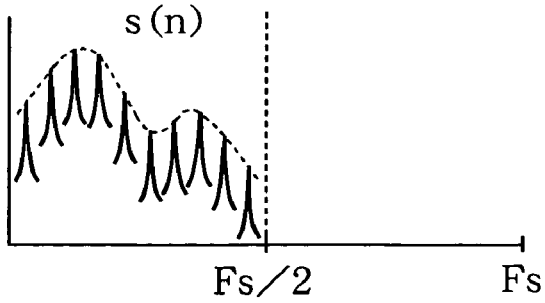
FIGS. 4A to 4D represent frequency spectra of various signals in the voice band expander in FIG. 3.

The dotted line in FIG. 4A represents the envelope of the frequency spectrum of the frame and thus the formant structure of the frame, as described by the LPC coefficients $a_i$ obtained by the LPC analyzer 101. The solid lines schematically represent the harmonic structure of the frame, which includes a fundamental frequency and harmonic frequencies thereof. Removal of the formants by the LPC filter 102 leaves a first reduced signal e(n) having a frequency spectrum with a flattened envelope (not shown).

Figure 4B:
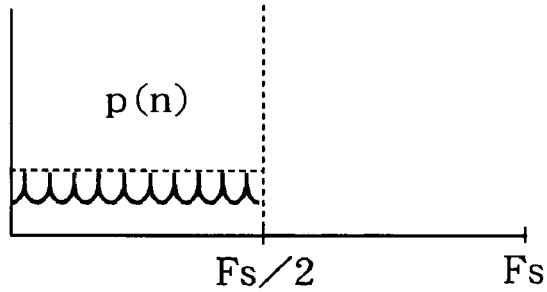

Further modification of the first reduced e(n) by the pitch filter 104 according to the pitch period L and pitch intensity b calculated by the pitch analyzer 103 produces the second reduced signal p(n) with the frequency spectrum shown schematically in FIG. 4B. For simplicity, this modification is represented by a simple attenuation of the intensity of the frequency components.

Figure 4C:
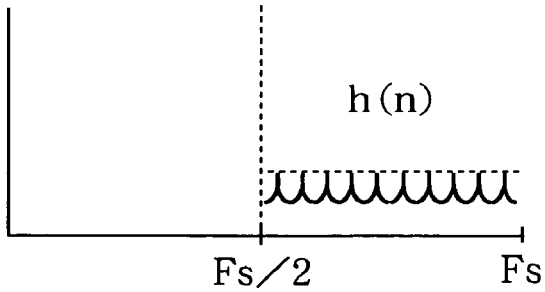

The signal p(n) is then folded over or shifted into the higher frequency band above the upper limit frequency Fs/2 by the high frequency signal generator 105 to generate the expanding signal h(n), which has the frequency spectrum represented in FIG. 4C.

Figure 4D:
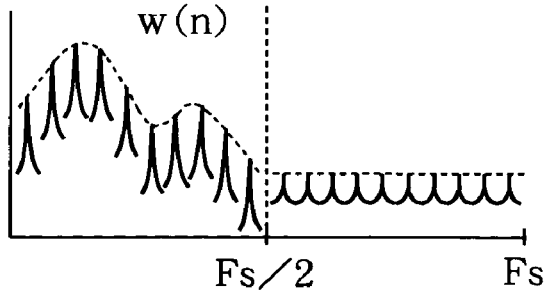

The adder 106 adds the input voice signal s(n) and the expanding signal h(n) together, thereby generating the band expanded signal w(n) with a frequency spectrum extending up to Fs, as indicated in FIG. 4D.

Because the high frequency components added to the input voice signal s(n) are based on the pitch and intensity of the input voice signal s(n), they represent components that would have been heard in the original voice signal before it underwent band limitation. Because they are derived from the residual signal after reduction or removal of formants, the band expanded signal has a natural sound, without false resonances that would not have been present in the original voice signal. As a result, the band expanded signal is improved in quality and comprehensibility.

The invention is not limited to the embodiment described above. Some possible variations are described below.

In the above embodiment, the voice band expander reduces (removes or attenuates) the formant structure of the input voice signal s(n) before it reduces (removes or attenuates) the pitch harmonic structure, but this order of operations may be interchanged.

In the embodiment above, both the formant structure and pitch harmonic structure are reduced, but only one or the other of them may be reduced.

In the embodiment above, the expanding signal h(n) is generated from the frequency spectrum of the input voice signal s(n) across the entire limited voice band, but the expanding signal h(n) may be generated only from frequency components of the input voice signal s(n) located near the frequency band of the expanding signal h(n). These frequency components may be extracted by use of a band-pass filter or similar device.

The vocal tract analysis method may be used instead of the LPC analysis method.

Uses of the voice band expander are not limited to IP telephones. The voice band expander can be employed in other types of apparatus.

Those skilled in the art will recognize that further variations are possible within the scope of the invention, which is defined in the appended claims.

What is claimed is:

1. A voice band expander for expanding a frequency band of an input voice signal with a frequency spectrum limited to frequencies below an upper limit, the voice band expander comprising:

a reduced signal generator for generating, from the input voice signal, a reduced signal with a modified frequency spectrum in which magnitudes of the frequencies in the entire frequency spectrum of the input voice signal are reduced;

a band expanding signal generator for generating, from the reduced signal, a band expanding signal having a frequency spectrum in a band higher than the upper limit of the limited band of the input voice signal; and a band expanded signal generator for combining the input voice signal and the band expanding signal, thereby to form a band expanded signal with an expanded frequency band, wherein the reduced signal generator reduces the frequency spectral envelope and the harmonic structure of the input voice signal, the reduced signal generator comprising:

a linear predictive coding (LPC) analyzer for carrying out an LPC analysis of the input voice signal;

an LPC filter for reducing the frequency spectral envelope of the input voice signal by using LPC coefficients obtained by the LPC analyzer;

a pitch analyzer, responsive to the output of the LPC filter, for determining a pitch and pitch intensity of the input voice signal; and a pitch filter for reducing the harmonic structure of the input voice signal according to the pitch and pitch intensity obtained by the pitch analyzer.

2. The voice band expander of claim 1, wherein the LPC filter multiplies the frequency spectrum of the input voice signal by a transfer function $H_{LPC}(z)$ in a z-transfer domain, the transfer function $H_{LPC}(z)$ being of the form $$H_{LPC}(z) = 1 - \sum_i \alpha^i \cdot a_i \cdot z^{-i}$$

where i is an index integer, $a_i$ is an LPC coefficient, $\alpha$ is a positive constant not exceeding unity, and z is a complex variable.

3. The voice band expander of claim 1, wherein the pitch filter multiplies the input voice signal by a transfer function $H_P(z)$ in a z-transform domain, the transfer function $H_P(z)$ being of the form $$H_P(z)=1-\beta\cdot b\cdot z^{-L}$$

where $\beta$ is a positive constant not exceeding unity, b is the pitch intensity, L is a pitch period, and z is a complex variable.

4. A voice band expander for expanding a frequency band of an input voice signal with a frequency spectrum limited to frequencies below an upper limit, the voice band expander comprising:

a reduced signal generator for generating, from the input voice signal, a reduced signal with a modified frequency spectrum in which a harmonic structure of the input voice signal is reduced;

a band expanding signal generator for generating, from the reduced signal, a band expanding signal having a frequency spectrum in a band higher than the upper limit of the limited band of the input voice signal; and a band expanded signal generator for combining the input voice signal and the band expanding signal, thereby to form a band expanded signal with an expanded frequency band, wherein the reduced signal generator reduces the harmonic structure of the input voice signal, the reduced signal generator further comprising:

a pitch analyzer for determining a pitch and pitch intensity of the input voice signal; and a pitch filter for reducing the harmonic structure of the input voice signal according to the pitch and pitch intensity obtained by the pitch analyzer.

5. The voice band expander of claim 4, wherein the pitch filter multiplies the input voice signal by a transfer function $H_P(z)$ in a z-transfer domain, the transfer function $H_P(z)$ being of the form $$H_P(z)=1-\beta\cdot b\cdot z^{-L}$$

where $\beta$ is a positive constant not exceeding unity, b is the pitch intensity, L is a pitch period, and z is a complex variable.

6. The voice band expander of claim 4, wherein the band expanding signal generator shifts the frequency spectrum of the reduced signal into the band higher than the upper limit of the limited band.

7. The voice band expander of claim 4, wherein the band expanding signal generator folds the frequency spectrum of the reduced signal over into the band higher than the upper limit of the limited band.

8. A voice communication apparatus receiving a band-limited voice signal, comprising the voice band expander of claim 4 for expanding the band of the received voice signal.

9. A method of expanding a frequency band of an input voice signal with a frequency spectrum limited to frequencies below an upper limit, the method comprising:

generating, from the input voice signal, a reduced signal with a reduced frequency spectrum in which a harmonic structure of the input voice signal is reduced;

generating, from the reduced signal, a band expanding signal having a frequency spectrum in a band higher than the upper limit of the limited band of the input voice signal; and combining the input voice signal and the band expanding signal and thereby forming a band expanded signal with an expanded frequency band, wherein generating the reduced signal comprises:

determining a pitch and pitch intensity of the input voice signal; and reducing the harmonic structure of the input voice signal according to the pitch and pitch intensity.

10. The method of claim 9, wherein reducing the harmonic structure further comprises multiplying the input voice signal by a transfer function $H_P(z)$ in a z-transform domain, the transfer function $H_P(z)$ being of the form $$H_P(z)=1-\beta\cdot b\cdot z^{-L}$$

where $\beta$ is a positive constant not exceeding unity, b is the pitch intensity, L is a pitch period, and z is a complex variable.

11. The method of claim 9, wherein generating a reduced signal further comprises:

carrying out a linear predictive coding (LPC) analysis of the input voice signal; and reducing the frequency spectral envelope of the input voice signal by using LPC coefficients obtained by the LPC analysis.

12. The method of claim 11, wherein reducing the harmonic structure further comprises multiplying the input voice signal by a transfer function $H_P(z)$ in a z-transform domain, the transfer function $H_P(z)$ being of the form $$H_P(z)=1-\beta\cdot b\cdot z^{-L}$$

where $\beta$ is a positive constant not exceeding unity, b is the pitch intensity, L is a pitch period, and z is a complex variable.

13. A tangible machine-readable medium storing a voice band expansion program to be executed by a computer to expand a frequency band of an input voice signal with a frequency spectrum limited to frequencies below an upper limit, the voice band expansion program including:

instructions for generating, from the input voice signal, a reduced signal with a reduced frequency spectrum in which a harmonic structure of the input voice signal is reduced;

instructions for generating, from the reduced signal, a band expanding signal having a frequency spectrum in a band higher than the upper limit of the limited band of the input voice signal; and instructions for combining the input voice signal and the band expanding signal and thereby forming a band expanded signal with an expanded frequency band, wherein the instructions for generating the reduced signal includes:

instructions for determining a pitch and pitch intensity of the input voice signal; and instructions for reducing the harmonic structure of the input voice signal according to the pitch and pitch intensity.

14. The method of claim 11, wherein reducing the frequency spectral envelope further comprises multiplying the input voice signal by a transfer function $H_{LPC}(z)$ in a z-transform domain, the transfer function $H_{LPC}(z)$ being of the form $$H_{LPC}(z) = 1 - \sum_i \alpha^i \cdot a_i \cdot z^{-i}$$

where i is an index integer, $a_i$ is an LPC coefficient, $\alpha$ is a positive constant not exceeding unity, and z is a complex variable.

15. The tangible machine-readable medium of claim 13, wherein the instructions for generating the reduced signal further includes:

instructions for carrying out a linear predictive coding (LPC) analysis of the input voice signal; and instructions for reducing the frequency spectral envelope of the input voice signal by using LPC coefficients obtained by the LPC analysis.

* * * * *